US005829874A

United States Patent [19]

Breeding

[11] Patent Number: 5,829,874

[45] **Date of Patent: *Nov. 3, 1998**

[54] BACKPACK MOUNTED PIVOTING MOTOR FOR CONCRETE FINISHING

[76] Inventor: Kenny D. Breeding, 11 Nimrod Cove, Maumelle, Ark. 72113

[ * ] Notice: The term of this patent shall not extend beyond the expiration date of Pat. No. 5,716,131.

[21] Appl. No.: 738,088

[22] Filed: Oct. 25, 1996

Related U.S. Application Data

[63] Continuation-in-part of Ser. No. 673,371, Jun. 28, 1996, Pat. No. 5,716,131.

[51] Int. Cl.[6] ..... B01F 11/04

[52] U.S. Cl. ..... 366/120; 224/197; 224/265; 224/643; 224/644

[58] Field of Search ..... 366/108, 116, 366/117, 120–123, 128, 129, 349, 600, 601; 224/197, 201, 261, 262, 265, 631, 643, 644

[56] References Cited

U.S. PATENT DOCUMENTS

| | | | |
|---|---|---|---|
| 1,981,076 | 11/1934 | Sells | 224/262 |
| 2,167,987 | 8/1939 | Mall | 366/122 |
| 2,430,817 | 11/1947 | Jackson | 366/123 X |
| 2,519,939 | 8/1950 | Sayre | 224/261 |
| 2,792,670 | 5/1957 | Haynes | 224/256 X |
| 3,042,386 | 7/1962 | Wyzenbeek | 366/122 |
| 3,180,625 | 4/1965 | Wyzenbeek | 366/122 |
| 3,188,054 | 6/1965 | Mason, Jr. | 366/121 |
| 3,395,894 | 8/1968 | Hedelin | 366/121 |
| 3,608,867 | 9/1971 | Hunter | 366/120 |
| 4,483,070 | 11/1984 | Junkermann | 224/262 X |
| 4,644,654 | 2/1987 | Howe et al. | 224/262 X |
| 4,658,778 | 4/1987 | Gamoh et al. | 224/644 X |
| 4,662,551 | 5/1987 | Dudley et al. | 224/262 X |

FOREIGN PATENT DOCUMENTS

| | | | |
|---|---|---|---|
| 768419 | 2/1957 | United Kingdom | 224/265 |

*Primary Examiner*—Charles E. Cooley
*Attorney, Agent, or Firm*—Stephen D. Carver

[57] ABSTRACT

A portable concrete finishing system comprising a backpack-borne, pivoting engine that powers a selected tool. A rigid frame supporting a four cycle motor is connected to the tool by a flexible power shaft. A removable vibration absorption system isolates the user from stress. A pair of integral, divergent shoulder harnesses protrude from the backpack top and an encircling, semi-elastic waist belt encircles the bottom. An integral belt tensioner permits the user to adjust belt tightness. The dampening system comprises a removable pad that has a pair of slip-on cuffs to captivate the ends of both shoulder harnesses. The frame also mounts a pair of ergonomic controls that may be easily manipulated by the user to control the power unit. A bracket assembly secures the engine to the frame. The assembly comprises a bracket pivotally coupled to a support that is attached directly to the frame. The bracket and support are hinged by a pin. The bracket directly attaches to the engine. The engine pivots in response to tool manipulation. The elongated flex-cable that connects the tool to the four cycle engine includes an internal compensator that accommodates thermal expansion and contraction.

13 Claims, 10 Drawing Sheets

BACKPACK MOUNTED PIVOTING MOTOR FOR CONCRETE FINISHING

CROSS REFERENCE TO RELATED APPLICATION

This patent application is a Continuation-In-Part of Ser. No. 08/673,371, filed on Jun. 28, 1996 entitled PORTABLE FOUR CYCLE BACKPACK PENDULOUS VIBRATOR, U.S. Pat. No. 5,716,131.

BACKGROUND OF THE INVENTION

I. Field of the Invention

The present invention relates generally to backpack mounted motors and associated tools for concrete work. More particularly, the present invention relates to a backpack mounted, pivoting motor for concrete work employing tools such as a pendulous vibrator. Preferably, the motor pivots so that an operator may readily manipulate the tool. The system also dissipates and absorbs vibrations produced by the power unit.

II. Description of the Prior Art

It is well settled that freshly poured concrete must be properly vibrated after placement to facilitate consolidation. Properly applied vibration settles and densifies the concrete mass, and helps eliminate air voids. Many vibrating systems for consolidating concrete are presently in use. Preexisting concrete vibrating equipment ranges from extremely large, vibrating and screed units that ride forms while traversing freshly poured concrete to smaller portable units.

Portable, motor driven tools for working freshly poured concrete may be secured to a backpack. These enable the contractor to properly densify smaller pours in a cost efficient manner. Backpack mounted units enable the operator to easily reach difficult-to-access places that would otherwise be unreachable by large equipment.

Known backpack-borne vibrator systems employ a two-cycle engine that must run at relatively high RPM. The engine connects via a flex-shaft cable to an eccentric vibrator unit that is immersed within the concrete. As the engine rotates the flex-shaft through the cable, vibration is created by the eccentric vibrator, and transmitted to the concrete. During operation heat builds up and the flex-shaft and casing components expand. Expansion causes "preloading," in that the flex-shaft is pressured axially, stressing mechanical parts. Also, the flex shaft itself is stressed, causing excessive rubbing against the outer casing. This stress and rubbing weakens the parts, and the excessive friction generates heat that burns the hands of the operator.

Two-cycle engines are normally used to reach the desired RPM ranges for proper vibration frequencies. These engines normally run very hot, partly because they run at relatively high RPM's. Two cycle engines lack the proper torque at low RPM's. Additionally, two-cycle motors require a proper mixture of gasoline and oil for optimum operation. However, in the field, the reality is that improper oil-gas mixtures are often used. Further, operators often over-rev the engines to obtain the relatively high rotational speed required by traditional flex-shaft eccentric vibrators to produce high frequency vibration. Speed increases aggravate the heat problem. As a result, two cycle systems are inefficient, cumbersome, and unreliable. They are a continuing maintenance nightmare.

Nevertheless, two-cycle engines have traditionally been preferred because they generally produce higher RPM's. High speed is necessary for traditional flex-shaft eccentric vibrators. Further, two-cycle engines are usually smaller and significantly lighter than conventional four-cycle engines, leading to their employment in backpack systems.

Common knowledge might suggest the use of four cycle engines. They may be heavier and slower, but they are inherently more reliable and they are comparatively maintenance free. However, these engines are not be used with conventional vibrators since they do not produce the required RPM's. Gear systems have been tried for increasing speed with four cycle systems, but the size and weight increase is practically unacceptable for portable, backpack systems.

Pendulous vibrators are known in the art. They are virtually maintenance free compared to eccentric vibrators. Pendulous vibrators produce high frequency vibration with relatively low RPM inputs. They effectively multiply the primary input speed of the drive cable system three to five times. However, they require more torque than typical flex-shaft eccentric vibrators. Pendulous vibrators overly stress two cycle drive causing premature bearing failure from the stress of heat unbalanced loads.

Therefore it would seem desirable to combine a four cycle engine with a pendulous vibrator. However the weight of a typical four cycle engine has made it undesirable. Further, translational forces that result from pendulous vibration are incompatible with flex-shaft power transmission systems linked to four cycle engines. Besides the fact that torque and RPM requirements are substantially different from two cycle systems, the shock waves transmitted through conventional cable systems by pendulous vibrators are incompatible with current designs. In a backpack borne unit, stress induced strains on the drive train are severely aggravated, necessitating substantial rethinking.

An ideal concrete working backpack system should meet a number of requirements. First, the system must enable the user to safely and comfortably transport the load on his back. Naturally, the backpack should be comfortable to wear while promoting operator maneuverability. Weight must be minimized, and it must be distributed relatively evenly to preserve operator mobility and balance. Weight borne upon the shoulders of the wearer must be cushioned to avoid rashes and discomfort. Mechanical parts should be flushly and compactly mounted- they must not obstruct or contact the operator. The load must be stable and it must be secure so that applicator dexterity is only minimally compromised. Vibration and heat must be isolated also.

Yet another constraint associated with proper slab consolidation by small backpack tools is the requirement that the operator physically traverse much of the site. For example, in order to consolidate a slab properly, the operator must typically vibrate several sections of the slab with a vibrator. These multiple vibrations generally require the operator to move extensively about the slab. In other words, the operator must actually walk over or around a substantial portion of the slab area in order to properly consolidate it. Consequently, backpack designs strive to preserve operator maneuverability while providing a comfortable means of transporting the motor and tools.

Not only must the entire unit meet the foregoing considerations, it must concurrently function smoothly and reliably to aid the operator in speedily fulfilling his job requirements in a workmanlike manner. In the past different backpack power unit designs have been proposed, at least partially in response to such design criteria.

Conventional prior art backpack designs generally employ a rigid frame with a pair of captivating shoulder straps. The user secures the load to the frame and then places his arms in the straps to lifts and carry both the backpack and the load. Some backpack designs include a waist belt mounted to the frame for distributing weight relatively evenly. A backpack with a waist belt eases the burden in carrying heavier loads presented by internal combustion engines.

A number of small internal combustion engines borne by backpack systems power a diverse variety of tools, including weed trimmers, air blowers, vacuums, etc. As backpack mounting systems evolve, the engines continue to get more powerful, and consequently bigger and heavier. Also, the tools typically employed have become more diverse.

These heavier engines and tools place greater demands upon the user during transportation and operation because of the heavy weight and the vibrations generated by the engine. Given the primary objectives of backpack design, it is imperative that the backpack adequately disperse the weight of the unit over the user's entire back while both absorbing and dissipating the vibrations generated by the engine. Furthermore, the backpack should not unnecessarily hinder operator maneuverability.

An ideal backpack would substantially isolate the vibrations generated by the engine from the user. A particularly ideal backpack would use a removable vibration isolation system. Such a system could be easily removed for cleaning purposes and could then be reinstalled when desirable.

Another important consideration with backpack mounted power units, particularly with heavier power units, is the ease of donning the backpack. All known prior art backpacks utilize a pair of shoulder straps which substantially captivate the shoulders. Unfortunately, the straps can be difficult to put on, especially if the user is inexperienced. Unfortunately, it may become necessary for the user to quickly remove the backpack in an emergency. Thus, an ideal backpack would have a simple coupling that could be easily connected or disconnected by the user. A particularly desirable backpack would have a quick connect belt and easy-on and easy-off straps or harnesses to facilitate quick user removal.

Moreover, while known rigid frame designs assure even distribution of stresses and stains, they restrict operator maneuverability undesirably. An ideal backpack design would promote operator maneuverability while retaining the benefits associated with rigid frame backpacks. Of course, such a backpack must heed the basic goal of comfortable movement. Since one prime consideration with any backpack mounted power unit is ease of use. Consequently, a backpack design that promoted operator maneuverability would be ideal. Such a backpack would permit the operator to easily deploy the tool, such as a pendulous vibrator or a strike-off, about the job site or from side-to-side.

The backpack should also permit fingertip control of the engine and associated tool. Most engines require an on/off switch as well as throttle control devices to regulate the engine speed. A particularly convenient backpack design would permit the user to easily manipulate such controls without removing or adjusting the backpack. A particularly ergonomic design would place these controls at the user's fingertips.

SUMMARY OF THE INVENTION

My pivoting motor backpack system overcomes the perceived problems associated with the known prior art as discussed above. The backpack comprises a rigid frame comfortably mounting a small four-cycle engine that pivots about a vertical axis. The motor powers a remote tool for working concrete (i.e., vibrating concrete to settle and/or consolidate it). As such, the backpack-supported power unit may be used to drive a variety of remote tools.

A pair of integral, divergent shoulder harnesses protrude from the top of the backpack unit. An encircling, semi-elastic waist belt protrudes from the frame bottom. Preferably, the belt comprises VELCRO® -brand pile and hook fasteners that enable the user to unfasten the belt with a single hand. An integral belt tensioner on each side of the belt permits the user to tighten one or both belt sides. Preferably, both belt tensioners use similar pile and hook fasteners. Thus, the belt may be coupled and adjusted with only one hand.

The shoulder harnesses cooperate with the encircling waist belt to secure the load on the user. Preferably, the shoulder harnesses are an easy-on and easy-off, open design that permits the user to simply slip his shoulders under them. Then, the belt is snugly coupled about the user's waist to mount the backpack on the user. Thus, the backpack may be easily donned by the user or quickly removed by the user as necessary.

The backpack system also uses a unique vibration dampening system to substantially reduce the transfer of vibrations generated by the engine and tool to the user. The vibration dampening system is also preferably removable from the frame for cleaning or other adjustment purposes. The dampening system preferably comprises a thick pad that has a pair of slip-on cuffs to captivate the ends of both shoulder harnesses. A plurality of snaps or other conventional attachment points secure the remainder of the system to the frame.

The frame mounts a pair of ergonomic engine controls that may be easily manipulated by the user to control the power unit. One control preferably governs engine operation while the other regulates engine speed.

A bracket assembly pivotally secures the engine to the frame. The assembly comprises a bracket pivotally coupled to a support. The support attaches directly to the frame. The bracket is pivotally coupled to the support by a hinge pin that penetrates the bracket and support. The bracket attaches directly to the engine. Thus, the support and bracket cooperate to permit pivotal movement of the engine relative to the frame. During user manipulation of the tool, the engine pivots to alleviate torsional stresses that may arise as a result of the flex cable pushing against the backpack frame.

Preferably the engine is of four cycle design. The remote driven tool, preferably a pendulous vibrator, is coupled to the engine through an elongated flex-cable that is quick-connectable to an engine fitting. Heat-generated cable elongation is accommodated by a special fitting joining the engine and cable.

Thus, a primary object of the present invention is to provide a highly mobile, portable concrete vibrating system that promotes operator mobility while enabling the operator to comfortably transport the unit.

Another important object is to provide a backpack-transported concrete vibrating system that successfully unites a pendulous vibrator with a four cycle engine.

A related object is to provide a flex-shaft system for a backpack-transported concrete vibrating system that successfully drives a pendulous vibrator with a four cycle engine.

A still further object is to provide a portable vibrator adapted to take advantage of the inherent reliability of four cycle engines.

Yet another object is to reduce maintenance and wear and tear by slowing down most of the components of a backpack vibrator system.

Another object is to provide an ergonomic, easily donned backpack power unit that absorbs and disperses vibrations generated by the engine.

A further basic object is to provide an easily removable vibration isolation system that may be field separated from the backpack for cleaning and/or adjustments.

Yet another basic object of the present invention is to provide a backpack mounted power unit that spreads the weight of the unit evenly over the user's shoulders and back.

A related object is to provide a pendulous vibrating system for concrete work that is comfortable and stable while promoting operator maneuverability.

Another primary object is to provide a backpack of the character described that may be quickly put on and removed by the user. It is a feature of the present invention that the securing belt may be uncoupled with one hand.

Another basic object of the present invention is to provide a portable power unit that may be used to power a variety of associated hand tools.

A related object of the present invention is to provide a portable power unit and an associated hand-held concrete vibrator.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 9:
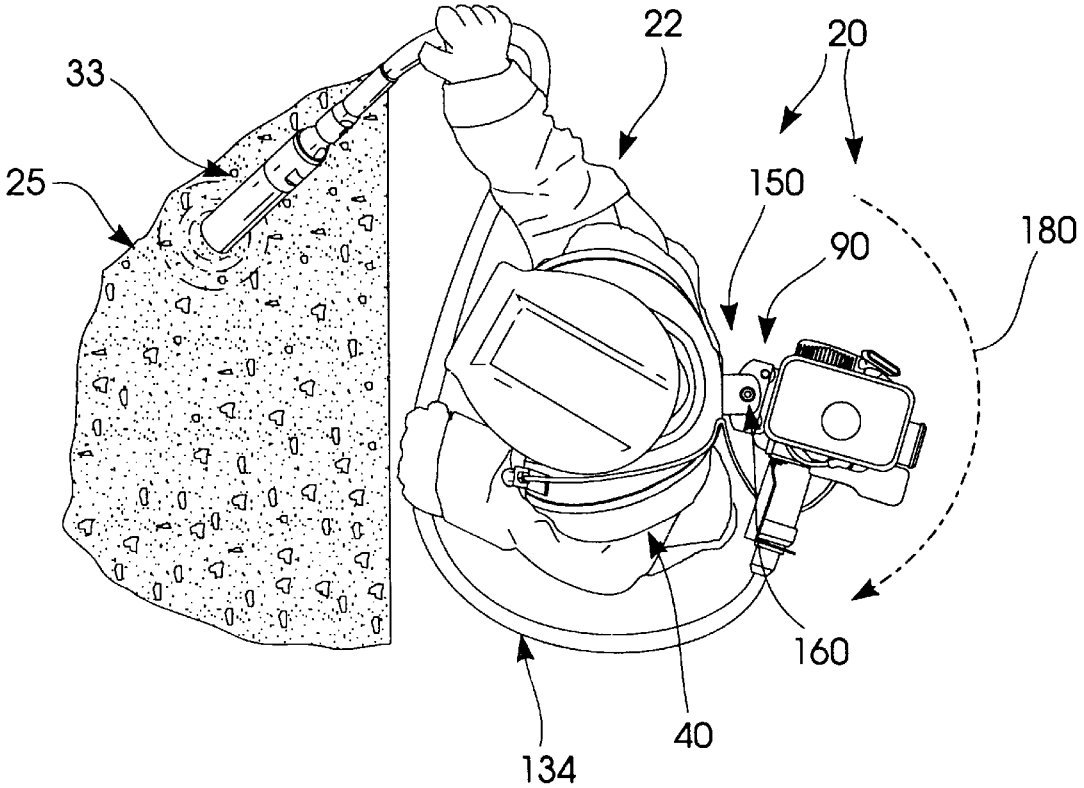
FIG. 9 is a top plan view similar to FIG. 8, but showing the user rotating in a clockwise direction.
Figure 10:
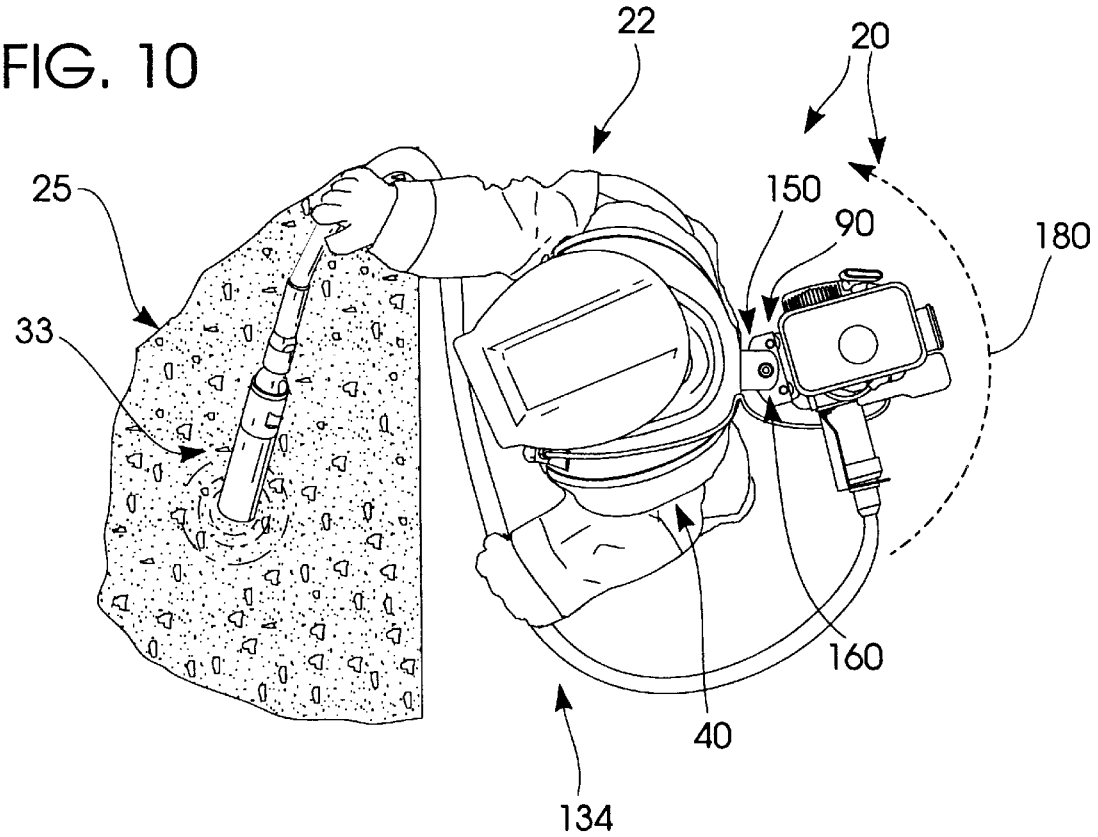
FIG. 10 is a top plan view similar to FIGS. 8 and 9, but showing the user rotating in a counterclockwise direction; and, FIG. 11 is a top plan view similar to FIG. 8, showing the user wearing the backpack and deploying an alternative tool.
Figure 11:
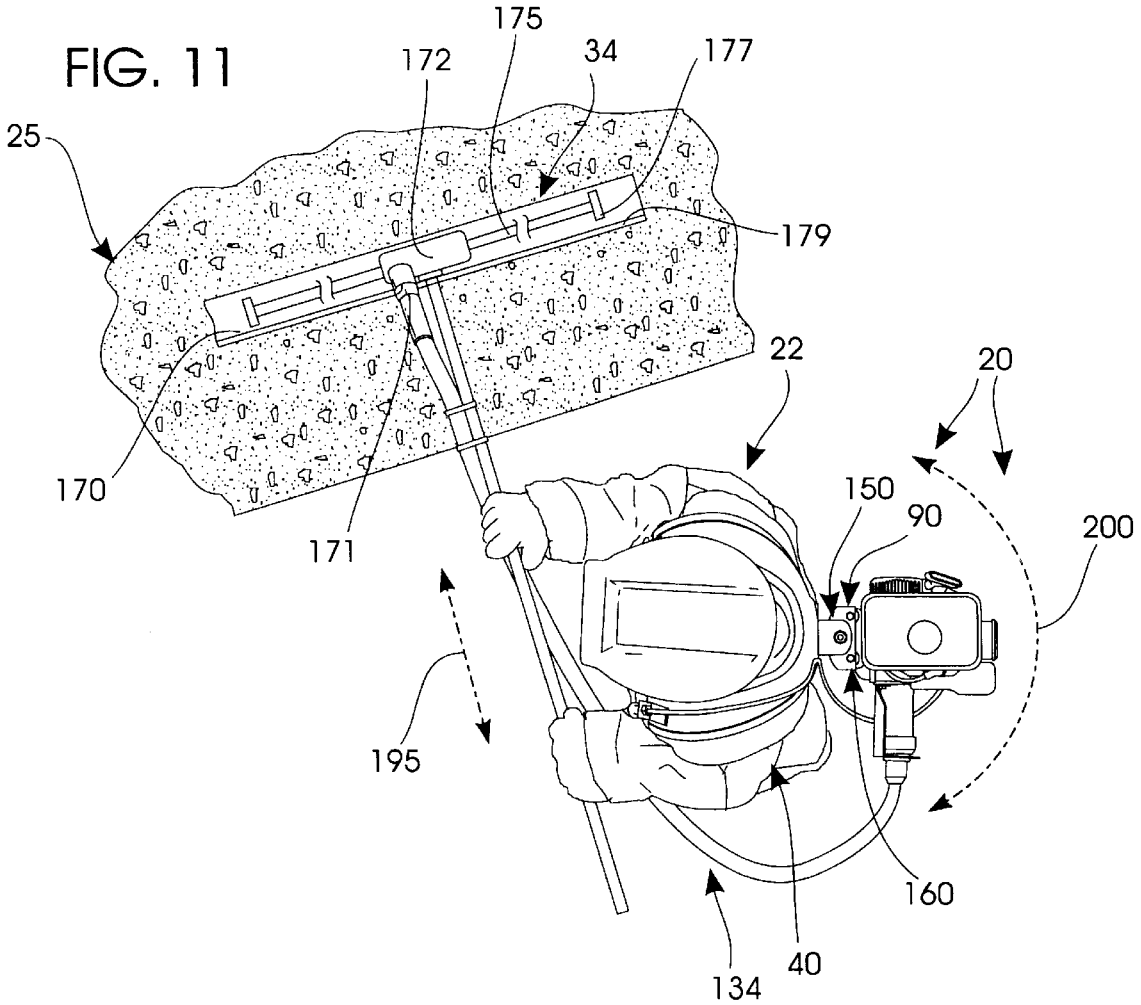

Referring more specifically to the drawings, my improved backpack system is generally designated by the reference numeral 20 in FIGS. 1–11. Backpack power unit 20 is worn by user 22 (FIGS. 1 and 8–11) during transportation and deployment around a job site 25 (FIGS. 8–11). The motor power unit 30 powers a remote concrete finishing tool such as a pendulous vibrator 33 (FIGS. 8–10) or finishing strike-off assembly 34 (FIG. 11).

The backpack power unit 20 comprises a backpack 35 secured to user 22 that supports the power unit 30 and vibrator 33. Power unit 30 generally comprises an internal combustion engine 31 controlled by switch 32A and throttle lever 32C. Preferably, switch 32A and lever 32C may be easily reached by user 22 when backpack unit 20 is worn. The backpack 35 comprises an elongated rigid frame 40 secured to the user 22 by a shoulder harness subframe 50 and a belt assembly 60. A vibration dampening system 80 fits between the backpack 35 and the user 22 to prevent the transfer of vibrations therebetween.

Figure 6:
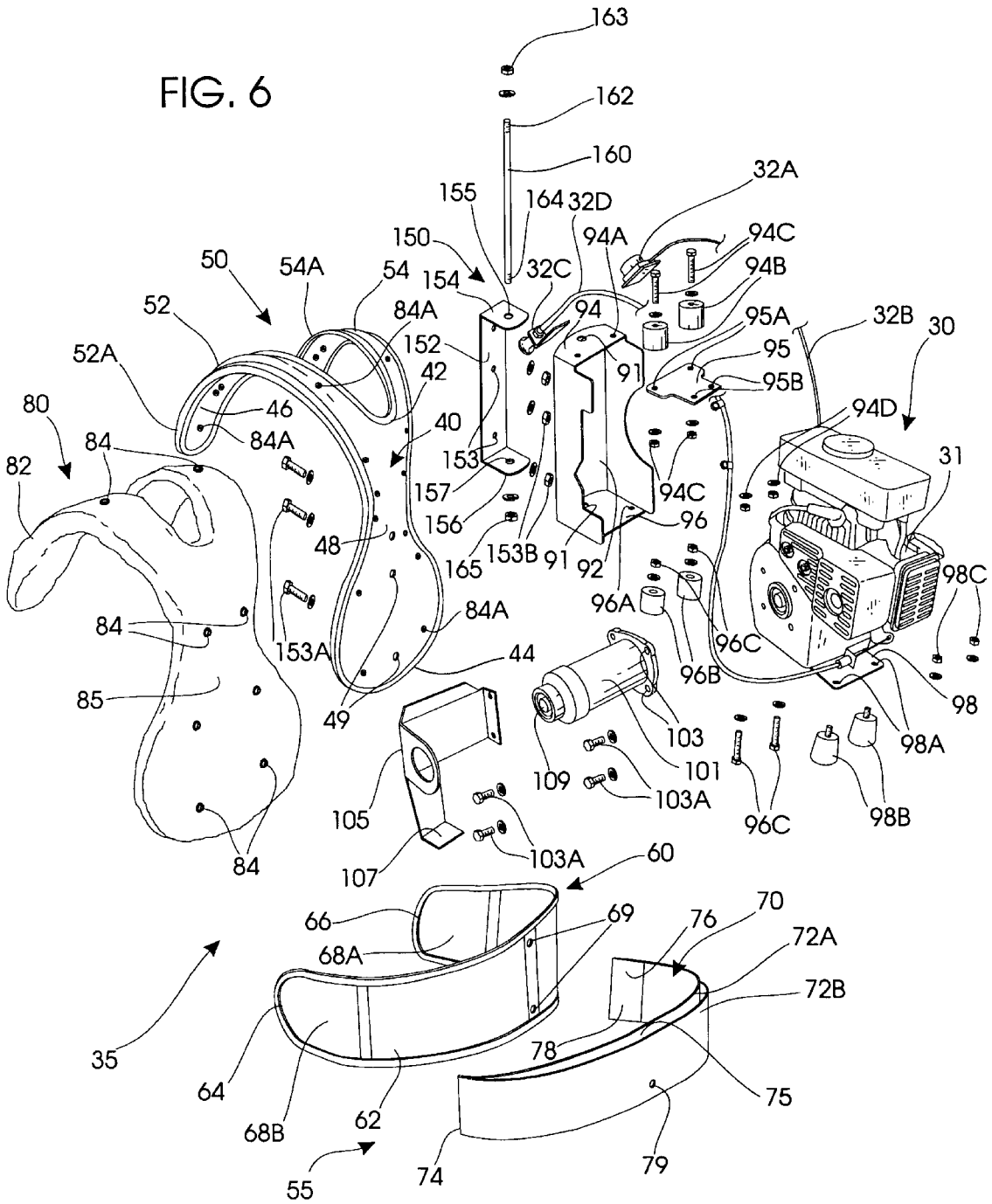
FIG. 6 is a partially exploded isometric view.
Figure 7:
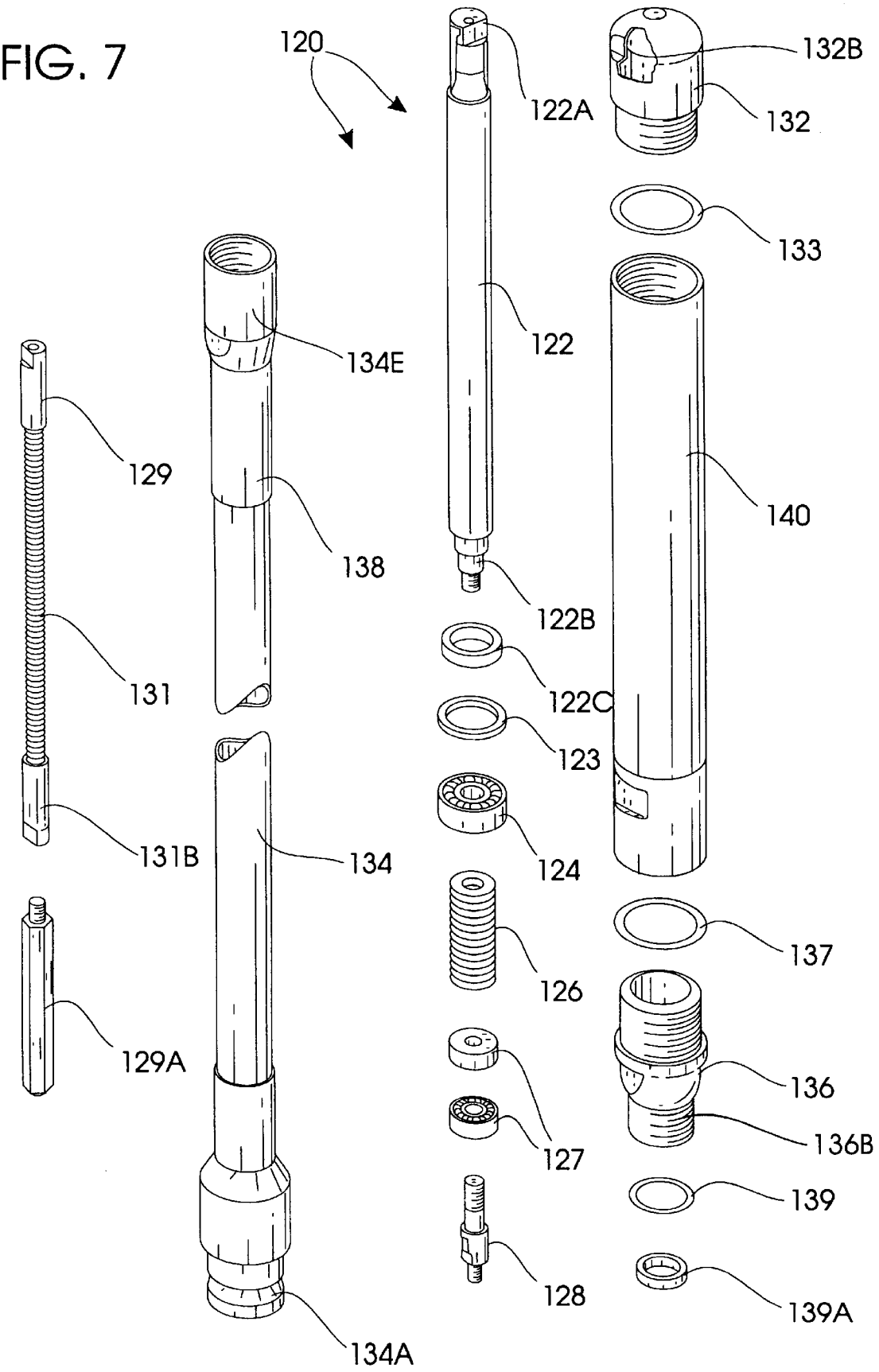
FIG. 7 is a partially fragmented, exploded isometric view of the preferred motor driven pendulous vibrator.

The rigid frame 40 has a top 42 and a spaced apart bottom 44 and an interior 46 and a spaced apart exterior 48 (FIG. 6). Two orifices 49 penetrate the frame 40 to permit the attachment of selected power units 30, as will be more fully discussed hereinafter. The frame 40 is secured on the user 22 by an integral, arcuate shoulder harness subframe 50 and a belt assembly 55.

Figure 1:
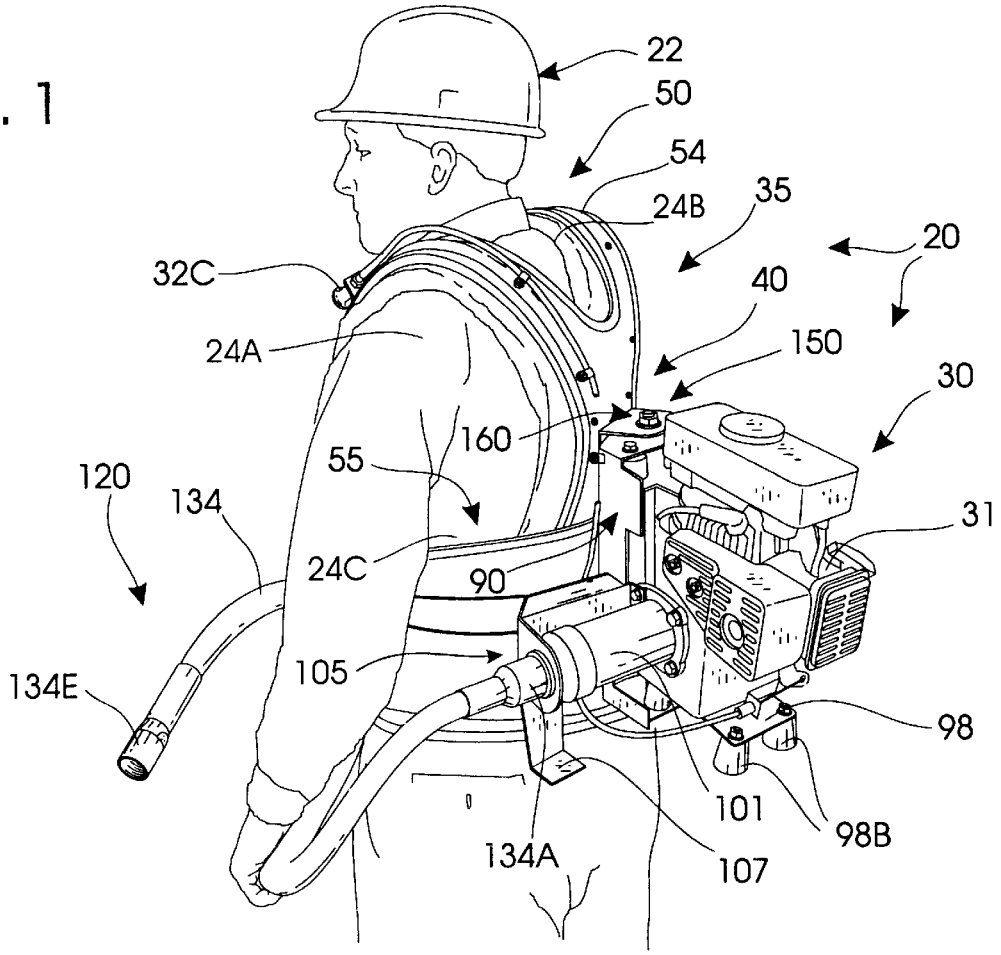
FIG. 1 is a fragmentary, pictorial view showing a preferred embodiment of my backpack unit worn by an user.
Figure 2:
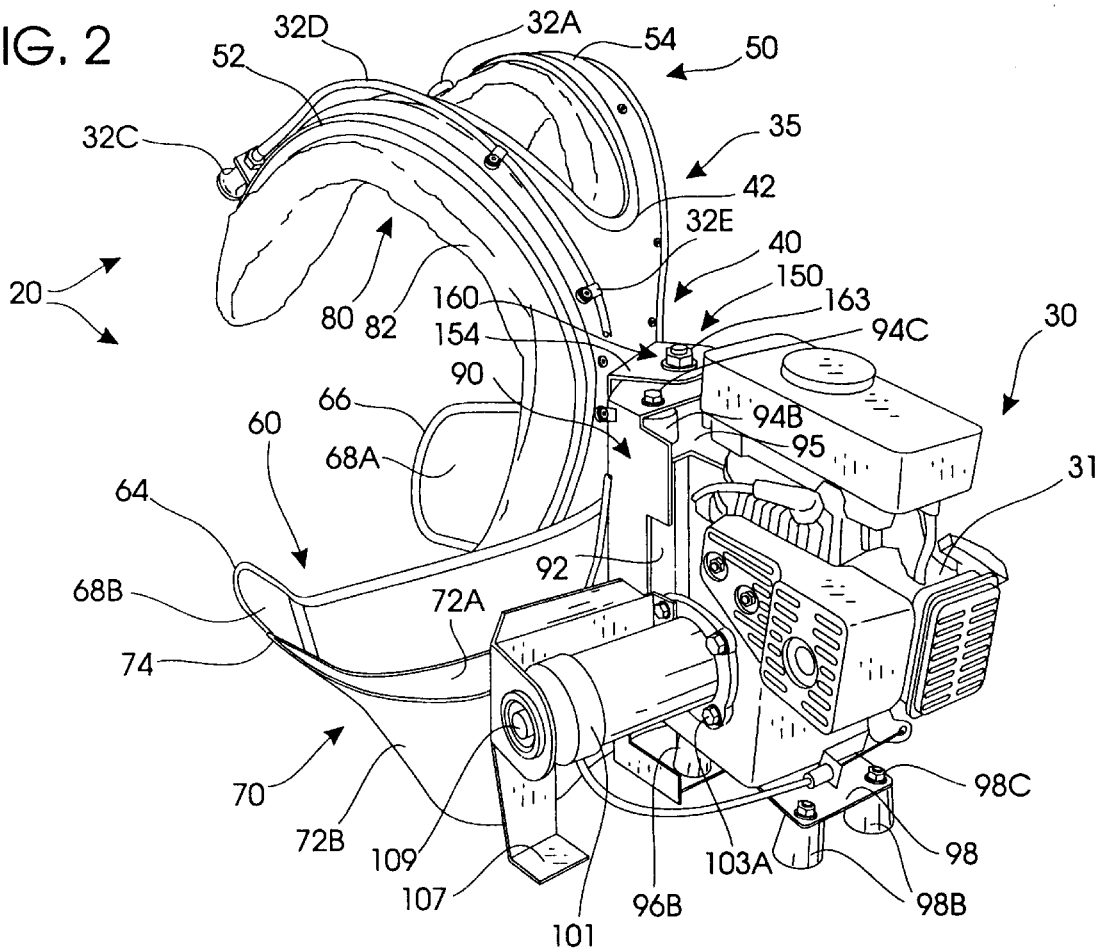
FIG. 2 is a left rear perspective view similar to FIG. 1 showing the backpack removed from the user.

The shoulder harness subframe 50 protrudes outwardly from the frame top 42. The subframe 50 comprises two divergent, arcuate shoulder harnesses 52, 54 that conform to and snugly fit over the user's shoulders 24A, 24B (FIG. 1). Each harness 52, 54 has a terminal end 52A, 54A that rests adjacent the user's chest when backpack unit 20 is properly worn.

Preferably the belt assembly 55 attaches to the frame bottom 44. Assembly 55 comprises a semi-elastic primary belt 60 and a tensioner belt 70. Primary belt 60 comprises an elongated webbing 62. Webbing 62 has a pair of spaced apart terminal ends 64,66. Preferably, each surface 68A, 68B of ends 64, 66 are appropriately covered with VELCRO fastening material. In the preferred embodiment, surface 68A is covered by VELCRO® hooks while surface 68B is covered by pile. Thus, surfaces 68A, 68B facilitate one-handed mating of ends 64, 66. Two spaced apart orifices 69 penetrate the belt 60 adjacent its midpoint to permit attachment of the belt 60 to the frame bottom 44. A complimentary tensioner 70 permits the user 22 to easily adjust the tightness of belt 60.

Tensioner 70 comprises a pair of elongated straps 72A, 72B joined at spaced apart ends 74, 76 that attach to belt 60 adjacent the user's sides 24C (FIG. 1). Preferably, inner strap 72A angles upwardly toward frame top 42 at midpoint 75 to maintain tension on rigid frame 50. Interior surface 78 on ends 74, 76 is appropriately covered with VELCRO hook material to fasten to surface 68B on belt ends 64, 66. Thus, tensioner ends 74, 76 maintain tension on ends 64, 66 to ensure that belt 60 is tight. An orifice 79 penetrates tensioner 70 adjacent midpoint 75 to secure tensioner 70 to frame 40.

When worn, backpack unit 20 uses a selectively removable vibration dampening system 80 to substantially reduce the vibrations transferred from the power unit 30 to user 22 during operation. The dampening system 80 attaches to the interior of frame 40 and shoulder harness 50. In other words, the dampening system attaches between the user and the backpack 35.

Preferably, the dampening system comprises a padded body 82 that conforms to the interior dimensions of the frame 40 and the shoulder harness 50. A plurality of conventional snaps 84 are spaced about the padded exterior surface 85 of the body 82 to secure it to appropriate receivers 84A on the frame 40 shoulder harness 50. A pair of hollow sleeves 86 slip over and captivate each shoulder harness end 52A, 54A to secure the upper section of the padded body 82.

Figure 4:
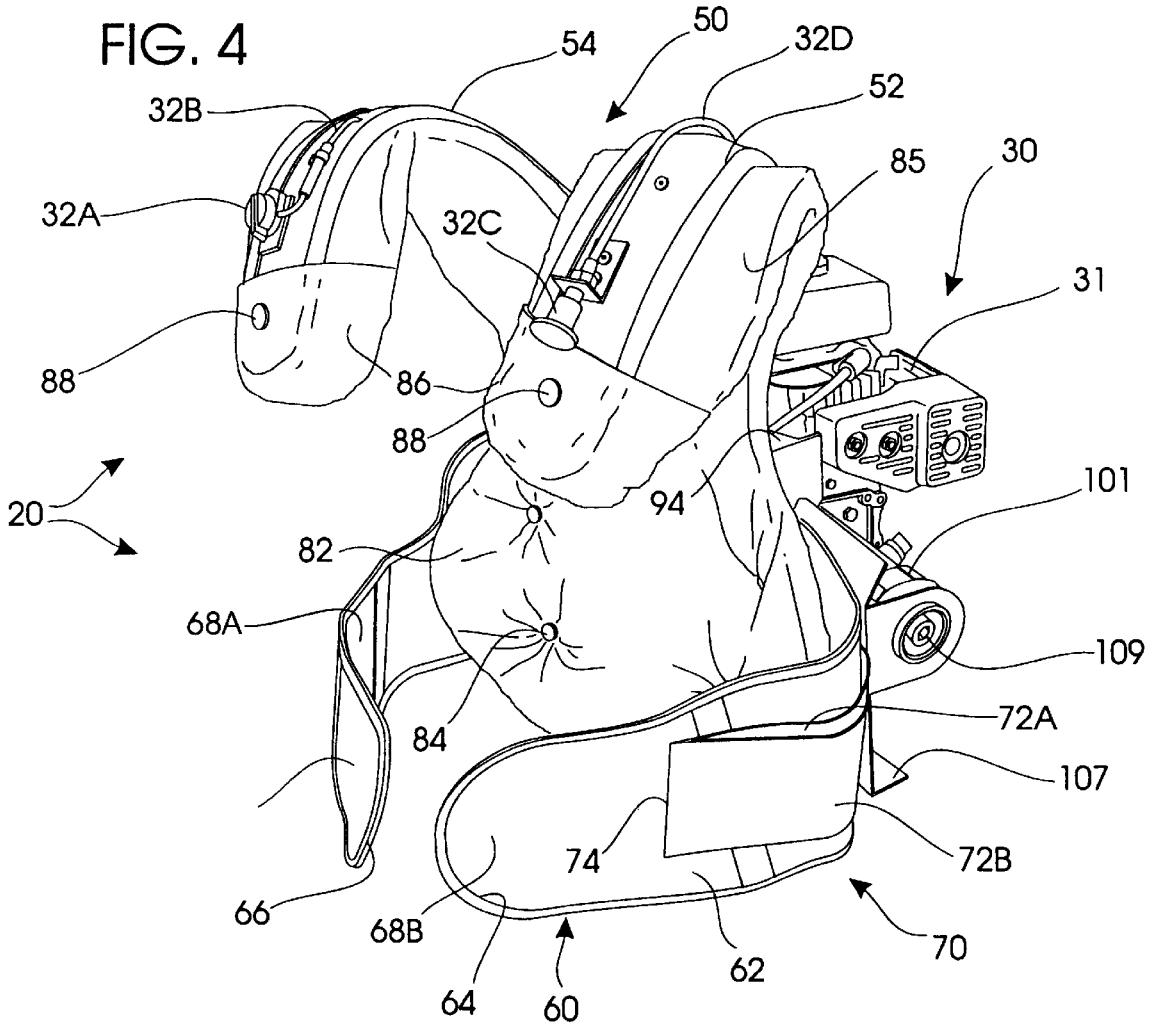
FIG. 4 is a left front perspective view.
Figure 5:
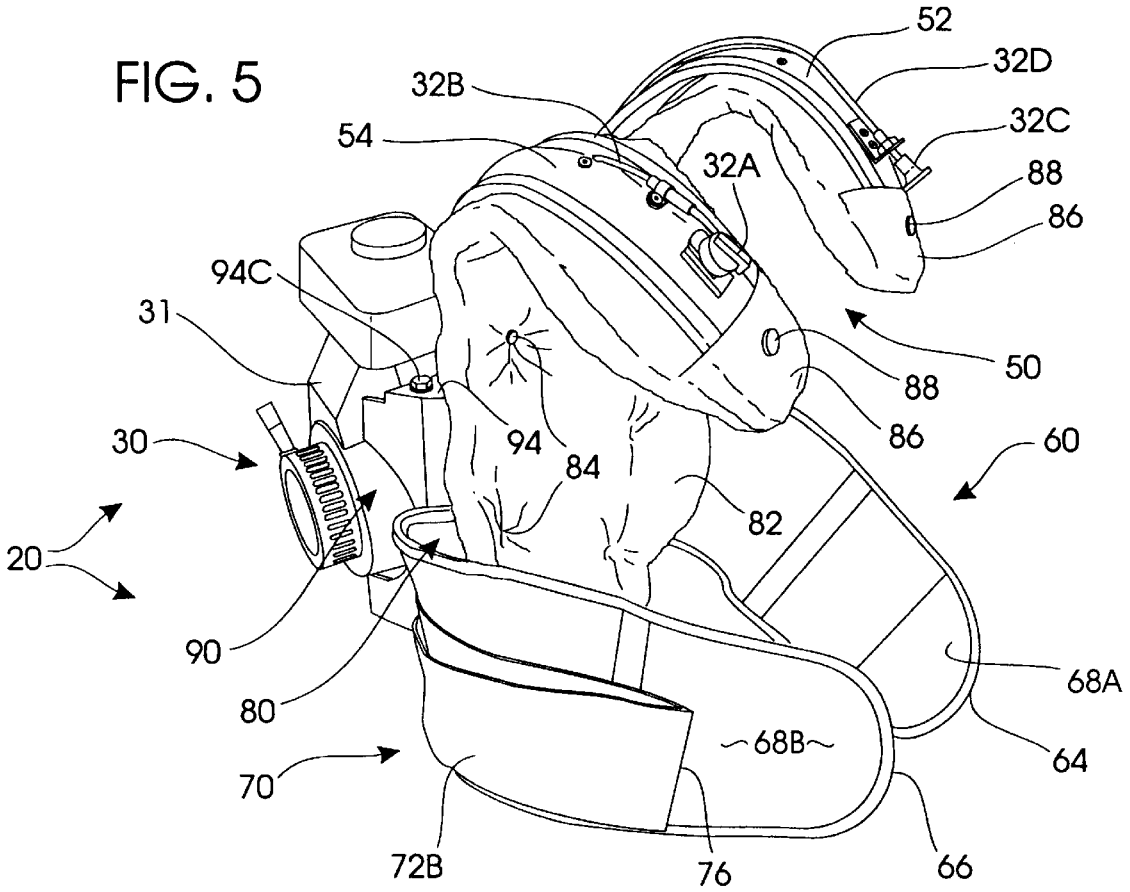
FIG. 5 is a right front perspective view.

Two snaps 88 secure the sleeves 86 to the shoulder harness 50 (FIGS. 4–5). Thus, the padded body 82 provides a cushion that dampens all vibrations generated by power unit 30 and/or tool.

As mentioned previously, frame mounting orifices 49 permit the selective attachment of alternative power devices to the backpack 35. A mounting bracket 90 and support 150 pivotally secure the chosen power unit 30 to frame 40. Bracket 90 and corresponding support 150 are preferably fit most units 30 with little modification. Thus, different power units 30 could be attached to multiple brackets 90 that could fit a single support 150 to make the units quick connecting to backpack 35.

Mounting bracket 90 comprises a flat mounting plate 92 terminating at cap 94 and spaced apart base 96. Cap 94 secures the upper portion of power unit 30 while base 96 secures the lower portion of power unit 30 to support 150 via aligned holes 91 penetrating cap 94 and base 96. Cap 94 is penetrated by a pair of mounting orifices 94A. Two resilient, vibration absorbing isolators 94B raise an intermediary attachment plate 95 above cap 94. Plate 95 is penetrated by orifices 95A that receive conventional mounting hardware 94C. A pair of studs (not shown) penetrating orifices 95B receive washers and nuts 94D to secure engine 31 to frame 40.

Base 96 and partially shown plate 98 perform functions similar to cap 94 and plate 95. Base 96 is penetrated by a pair of orifices 96A. Two resilient, vibration reducing isolators 96B are placed between appropriate mounting hardware 96C and plate 98. A pair of resilient, studded vibration isolators 98B have projecting threads that penetrate orifices 98A on the outer portion of plate 98 and receive appropriate mounting hardware 98C. Thus the power unit 30 is securely attached to the bracket 90 at its upper and lower extremities.

Figure 3:
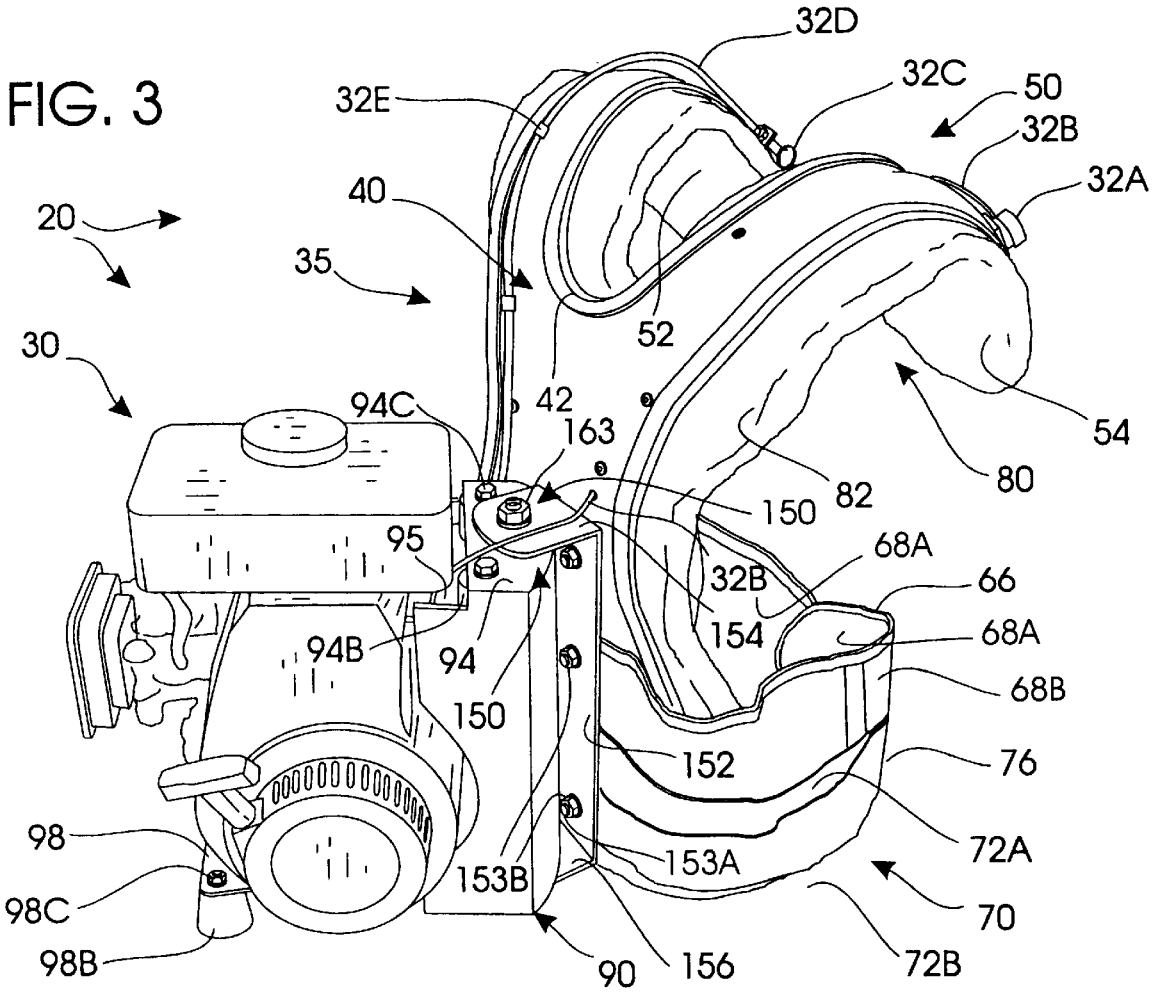
FIG. 3 is a right rear perspective view similar to FIG. 2.

Bracket 90 in turn is hingedly secured to backpack frame 40 by support 150. Support 150 comprises an elongated plate 152 penetrated by three spaced apart mounting holes 153. Holes 153 permit support 150 to be securely fastened to frame 40 via bolts 153A and appropriate nuts 153B (FIG. 3). Of course, other conventional attachment devices such as rivets, etc. could be used. Plate 152 has a lid 154 at one end and a base 156 at the other. Lid 154 is penetrated by hole 155 while base is penetrated by an aligned hole 157.

A hinge pin 160 penetrates holes 91 and 155, 157. Thus, hinge pin 160 pivotally couples bracket 90 to support 150 like a conventional door hinge. Hinge pin 160 has a pair of threaded, spaced apart ends 162 and 164 that extend outwardly beyond holes 155, 157. End 162 receives nut 163 while end 164 receives nut 165 to secure pin 160 in its pivotal relationship.

The support 150 secures the bracket 90 to the backpack frame 40. The bracket 90 in turn secures the engine 31. Thus, the engine 31 is ultimately mounted securely upon the frame 40. The engine 31 pivots about pin 160. The extra degree of freedom resulting from the pivotal movement of the engine permits the user 22 to easily deploy the associated tool, as is discussed thoroughly hereinafter.

As stated previously, power unit 30 preferably comprises an internal combustion engine 31. Engine 31 is controlled by kill switch 32A and throttle control lever 32C. Kill switch cable 32B is appropriately routed through an orifice in frame 40 while throttle control cable 32D is appropriately fastened to frame 40 by tabs 32E.

Motor 31 (FIG. 6) turns a quick coupling assembly 101 that is secured to the engine by conventional mounting hardware 103A penetrating orifices 103. A reinforcing bracket 105 secures the end of assembly 101. Bracket 105 is also secured via mounting hardware 103A. Reinforcing bracket 105 ends with a terminal stand 107 that cooperates with isolators 98B to support backpack unit 20 when placed upon the ground or other similar surface. An internal, rotatable quick coupling 109 housed in assembly 101. is driven by the output shaft of engine 31. It is quick connected to the flex hose 134 leading to the pendulous vibrator 120.

The preferred pendulous vibrator 120 (FIG. 7) is employed to consolidate plastic concrete during finishing. Vibrator 120 is powered by motor 31 (FIG. 6). Vibrator 120 is driven by an elongated, flexible hose 134 assembly whose end 134A is removably quick coupled to the motor quick connect 109. The opposite end 134E is coupled to a pendulous vibrator end reducer 136 FIG. 6. A flexible drive extension 131 threadably couples to a compensator 129A at end 131B. The compensator comprises a rigid, floating hex extension that is received within the motor quick connect 109 and is free to slide in response to bending or twisting of the flexible drive extension 131, or to heat expansion or contraction. Flexible drive extension 131 is coaxially rotated within hose assembly 134. Its drive head 129 is threadably coupled to shaft connector 128.

The inner pendulum shaft 122 coaxially rotates within casing 140. When assembled and in use it points downwardly coaxially within casing 140. Shaft 122 has an eccentric shoulder 122A at one end. An opposite threaded end 122B that penetrates oil seal 122C. A spacer 123 and bearing 124 position the shaft against a spring 126 that absorbs longitudinal displacements of pendulum shaft 122. Bearing structure 127 cooperatively captivates spring 126 against shaft 122. Shaft 122 is thus rotated by the slidable compensator 129A that is quick coupled to the motor. Flex drive 131 is rotated by spline 109 when the engine 31 is running. Axial forces are dissipated by movement of compensator 129A, that also compensates for thermal expansion as the system gets hotter.

Vibrator casing 140 threadably receives a terminal nose 132 about intermediary O-ring 133 that seals the connection. Casing 140 terminates at its opposite end with a reducer 136 sealed with an intermediary O-ring 137. The shaft 122 and its end 122A rotatably collide during rotation with inner shoulder 132B of nose 132. Shaft 122 hangs downwardly like a pendulum within casing 140, and when the casing is tilted, shaft end 122A forcibly contacts shoulder 132B. This periodic, accelerated impact causes intense vibration that is distributed through the apparatus to the concrete at frequencies three to five times higher than shaft rotational speed.

Importantly, the bearings 124 and 127, and other parts "behind" shoulder 132B are running at the primary input speed, reducing wear and friction and heat accumulation. Adaptor 136 is connected to the opposite end of casing 140 and sealed with gasket 137. End 134E of casing 134 is threadably mated to end 136B of reducer 136 with an appropriate O-ring 139 and oil seal 139A therebetween.

The backpack power unit 20 can power other concrete finishing accessories (FIG. 11). For example, unit 20 can power a portable, finishing strike-off assembly 34. Finishing strike-off 34 comprises an elongated, transverse blade 170 used to strike-off and finish the concrete. Blade 170 is made from channel iron, and it comprises at least one upturned lip 179 that functions as a strike-off. Power applied at head 171 through a threaded joint from conduit 134 is delivered to an oil bath gear box 172 that generates increased RPM's (i.e., it is used as a speed multiplier). Gear box 172 drives built-in eccentric weights for vibration purposes when blade 170 is less than six feet long. In the best mode, with longer blades, gear box 172 powers a flex drive shaft 175 to forcibly rotate one or more oil batch eccentrics 177. In this manner relatively higher frequency vibrations are achieved with relatively low RPM primary power.

OPERATION

In use the apparatus is donned by user 22 who simply places the shoulder harnesses 52, 54 over shoulders 22A, 22B. Then, the belt 60 is fastened by mating ends 64, 66. The belt 60 is then tightened by attaching tensioner ends 74, 76 adjacent each end 64, 66 respectively.

The motor may then be started or it may alternatively be started before donning the backpack 35. The engine may be conveniently governed by manipulating the kill switch 32A. The user 22 can also conveniently regulate the engine speed via lever 32C.

Removal of the backpack power unit 20 is reverse to the donning procedure. First, the engine 31 is killed via switch 32A. Then, the tensioners are unfastened by pulling ends 74, 76 outwardly. Next, the belt 60 is unfastened by pulling ends 64, 66 outwardly. Finally, the backpack may be placed on the ground or other suitable surface 27 and the harnesses 52, 54 removed from the user's shoulders 24A, 24B.

When using the pendulous vibrator, motor operation causes vigorous rotation of the shaft 122 that forces contact of shoulder 122A against inner shoulder 132B. Substantial vibration is produced by these periodic, rotation induced collisions. Nose 132 is simply immersed within the mass of concrete to be consolidated. When used with other tools such as strike-off 34, the vibrations typically vibrate a blade 170. Depending upon heat buildup, elongation of the vibrating assembly and the flexible connection is compensated for by the compensator 129A.

As the tool, either vibrator 33 or strike-off 34, is manipulated by user 22, the user must typically move the tool about the site 25, either in several different locations or from side-to-side (FIGS. 8–11).

Figure 8:
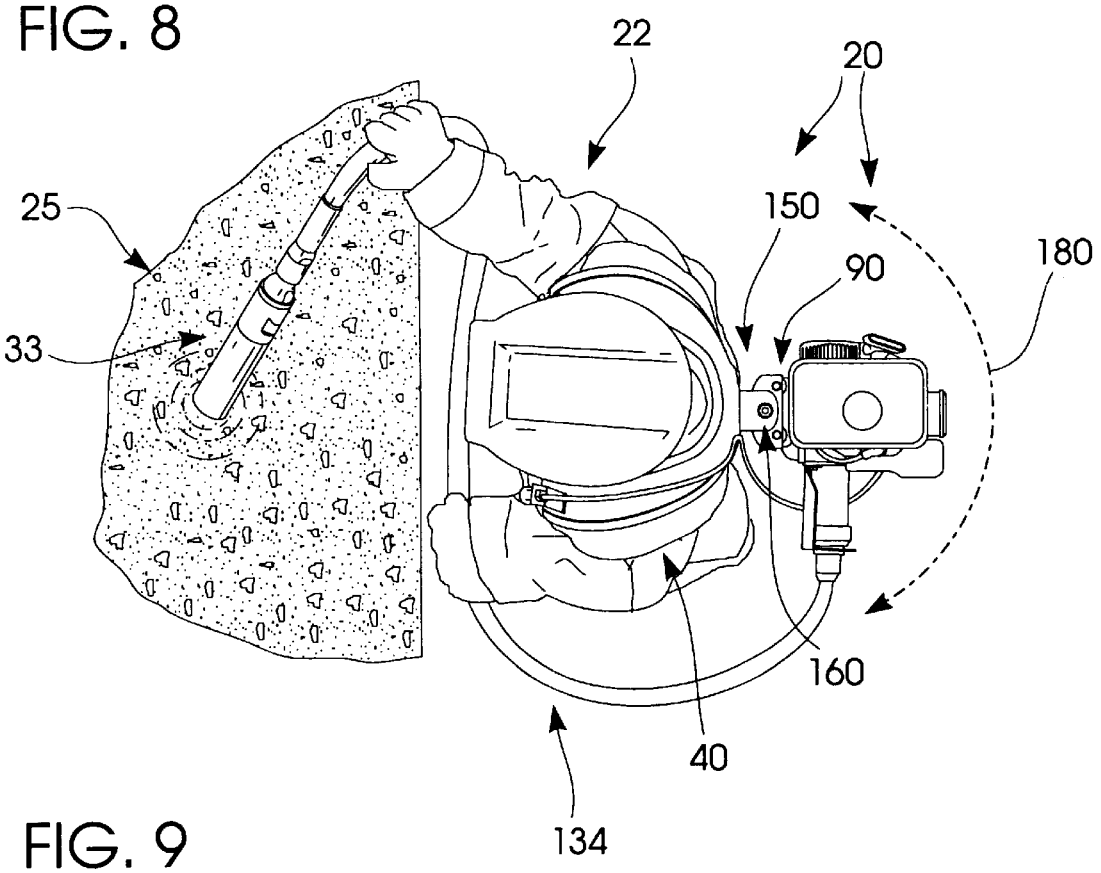
FIG. 8 is a top plan view of the user wearing the backpack while manipulating the preferred pendulous vibrator.

Preferably, the user 22 moves the tool with some rapidity so that finishing operations proceed quickly and smoothly. As can be seen in FIGS. 8–10, as user 22 moves vibrator 33 about site 25, engine 31 may pivot about pin 160 in either direction as indicated by arrow 180. When the user 22 moves the vibrator to his right (FIG. 9), the engine 31 pivots about pin 160 to his left as indicated by arrow 185. When the user 22 moves the vibrator to his left (FIG. 10), the engine 31 pivots about pin 160 to his right as indicated by arrow 190. Thus, the pivoting movement of engine 31 about pin 160 permits the user 22 to easily manipulate the tool without placing torsional stains upon frame 40. Similarly, when the user 22 manipulates strike-off 34 from side-to-side (as indicated by arrow 195 in FIG. 11) about site 25, engine 31 also pivots about pin 160 in either direction (indicated by arrow 200). Consequently, during user manipulation of the tool, the engine 31 pivots about pin 160 to alleviate any torsional stresses that may arise as a result of the flex cable 134 pushing against the coupling 109 and subsequently against frame 40. Such stresses could lift harnesses 52, 54 or apply undue stains upon belt 55 or otherwise discomfort the user 22.

The finishing strike-off assembly 34 enables the operator to grade or strike off a relatively small concrete pour, especially those at work sites that are relatively confined or inaccessible. The strike-off blade 170 is coupled to the powered conduit 134, and at the same time the device is moved about over the concrete surface to finish and strike off the wet cement.

Thus the apparatus described facilitates and accommodates the relatively high power of the four cycle motor and the intense vibration of the pendulous vibrator or other tools. At the same time, operator comfort, ease of use, and safety are insured.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable concrete treatment system adapted to be worn and transported by a user around a job site for consolidating plastic concrete, said system comprising:

a four cycle internal combustion motor for powering the system;

backpack means for transporting said motor, said backpack means comprising protruding shoulder harness means for engaging the shoulders of said user;

means for mounting said motor to said backpack means, said mounting means comprising:

a bracket supporting said motor;

a support centered upon and attached to said backpack; and, means for pivotally coupling said bracket to said support, said coupling means establishing a pivot axis substantially parallel with the user and substantially perpendicular to the job site;

a flexible connection quick connected to and powered by said motor and adapted to be carried by said user about a job site for powering a concrete tool;

compensator means within said connection for accommodating stresses; and, said concrete tool for finishing concrete adapted to be remotely powered by said connection while said user supports said backpack means.

2. The system defined in claim 1 wherein said concrete tool is a portable strike off vibrated by connection with said motor.

3. The system defined in claim 2 wherein said compensator means torsionally couples said flexible connection to said motor, and said compensator means is slidable within said flexible connection in response to heat buildup and axial stresses to prevent over tensioning of said connection.

4. The system defined in claim 3 wherein said backpack means comprises a dampening system for absorbing vibrations generated during operation and isolating the user from them.

5. The system defined in claim 4 wherein said concrete tool is a portable strike off vibrated by connection with said motor.

6. The system defined in claim 4 wherein said dampening system comprises an elongated pad selectively secured to said backpack means.

7. The system defined in claim 1 wherein said compensator means is axially slidable within said flexible connection in response to heat buildup or stress to prevent tensioning of said connection.

8. A portable, backpack mounted concrete finishing system adapted to be worn and transported by a user about a job site when finishing plastic concrete, said system comprising:

an internal combustion motor for powering the system:

a backpack worn by the user to support said motor, said backpack comprising:

a rigid frame comprising shoulder harness means for substantially supporting the backpack on the user's shoulders;

belt means attached to said frame for securing the backpack to the user;

tensioning means for tightening said belt means;

control means for manipulating said motor, said control means mounted on said frame;

vibration isolator means for isolating motor vibration from the user;

dampening means mounted on said shoulder harness means for absorbing vibrations produced by said motor;

means for pivotally mounting said motor on said backpack, said mounting means comprising:

a bracket for supporting said motor;

a support centered upon and attached to said backpack; and, means for pivotally coupling said bracket to said support, said coupling means establishing a pivot axis substantially parallel with the user and substantially perpendicular to the site;

a portable tool for finishing concrete adapted to be remotely powered by said motor while said user supports said backpack;

flexible connection means for connecting said motor to said tool;

whereby said means for pivotally mounting said motor to said backpack eliminates the transfer of torsional stain from said flexible connection means to said backpack when said tool is manipulated.

9. The system defined in claim 8 wherein said flexible connection means comprises an elongated flex drive having two spaced apart ends, the first of said ends coupled to said tool and the second of said ends quick connected to said motor.

10. The system defined in claim 8 further comprising compensator means for coupling said flexible connection means to said motor.

11. The system defined in claim 8 wherein said tool comprises a pendulous vibrator.

12. The system defined in claim 8 wherein said tool comprises a strike-off.

13. A portable concrete vibrating system adapted to be worn and transported by a user over a construction site for consolidating plastic concrete, said system comprising:

a backpack worn by a user for supporting and transporting the system;

a motor for powering the system;

means for hingedly mounting said motor to said backpack;

a vibrator powered by said motor, said vibrator comprising an elongated casing and a pendulum shaft rotatably, generally coaxially disposed therewithin for forcibly impacting the casing in response to the movement of said pendulum shaft;

a flexible connection between said backpack and said vibrator extending between the user and the concrete; and, said flexible connection quick connected to and powered by said motor and adapted to be carried by said user about a job site for powering a concrete tool; and, said concrete tool for finishing concrete adapted to be remotely powered by said motor while said user supports said backpack; and, said means for hingedly mounting said motor to said backpack comprising:

a bracket for supporting said motor;

a support centered upon and attached to said backpack; and, means for pivotally coupling said bracket to said support, said coupling means establishing a pivot axis substantially parallel with the user and substantially perpendicular to the site;

compensating means within said flexible connection for accommodating axial stresses caused by said vibrator, wherein said compensating means torsionally couples said flexible connection to said motor, and said compensating means is slidable within said flexible connection in response to heat buildup and axial stresses to prevent over tensioning of said flexible connection; and, a dampening system comprising an elongated pad selectively secured to said backpack.

* * * * *